US009359166B2

(12) United States Patent
Takahashi

(10) Patent No.: US 9,359,166 B2
(45) Date of Patent: Jun. 7, 2016

(54) SHEET EJECT DEVICE, FULLNESS DETECTING METHOD, AND COMPUTER-READABLE RECORDING MEDIUM

(71) Applicant: Satoshi Takahashi, Kanagawa (JP)

(72) Inventor: Satoshi Takahashi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/029,140

(22) Filed: Sep. 17, 2013

(65) Prior Publication Data

US 2014/0016736 A1 Jan. 16, 2014

Related U.S. Application Data

(63) Continuation of application No. 13/067,524, filed on Jun. 7, 2011, now Pat. No. 8,561,983.

(30) Foreign Application Priority Data

Jun. 25, 2010 (JP) ..... 2010-145237
Apr. 15, 2011 (JP) ..... 2011-090715

(51) Int. Cl.
*B65H 31/00* (2006.01)
*B65H 43/04* (2006.01)
(Continued)

(52) U.S. Cl.
CPC ..... *B65H 43/06* (2013.01); *G06M 9/00* (2013.01); *B65H 2301/541* (2013.01); *B65H 2511/30* (2013.01); *B65H 2511/40* (2013.01); *B65H 2513/511* (2013.01); *B65H 2513/53* (2013.01); *B65H 2557/24* (2013.01); *B65H 2801/06* (2013.01)

(58) Field of Classification Search
CPC ..... B65H 43/06; B65H 2511/40; B65H 2801/06; B65H 2513/53; B65H 2301/541; B65H 2513/511; B65H 2557/24; B65H 2551/30
USPC ..... 271/213, 214, 258.03, 256, 215, 207
See application file for complete search history.

(56) References Cited

U.S. PATENT DOCUMENTS 4,557,589 A * 12/1985 Fukushi ..... 399/403
5,192,261 A * 3/1993 Honjo et al. ..... 493/29
(Continued)

FOREIGN PATENT DOCUMENTS

EP 0768266 A1 4/1997
JP 2003-192225 A 7/2003

OTHER PUBLICATIONS

Extended Search Report for corresponding European Application No. 1169905.4 dated Nov. 23, 2012.

*Primary Examiner* — Patrick Cicchino
(74) *Attorney, Agent, or Firm* — Harness, Dickey & Pierce PLC

(57) ABSTRACT

A sheet eject device is provided for detecting whether a sheet eject tray is filled with ejected sheets. The sheet eject device includes an ejecting unit that ejects sheets onto the sheet eject tray; a counting unit that counts an accumulated eject number every time a sheet is ejected by the ejecting unit; a storing unit that stores a defined eject number threshold and a defined eject interval time; a fullness detecting unit that detects that the sheet eject tray is filled with ejected sheets when the accumulated eject number counted by the counting unit exceeds the defined eject number threshold; and a reset unit that resets the accumulated eject number counted by the counting unit when an eject interval time exceeds the defined eject interval time, the eject interval time extending from when one sheet is ejected until a next sheet is ejected by the ejecting unit.

9 Claims, 9 Drawing Sheets

(51) Int. Cl.
*B65H 43/06* (2006.01)
*G06M 9/00* (2006.01)

(56) References Cited

U.S. PATENT DOCUMENTS 5,761,567 A * 6/1998 Yoshizuka ..... 399/17
2003/0137102 A1* 7/2003 Saito ..... 271/306
2006/0180999 A1* 8/2006 Suzuki et al. ..... 271/176
2007/0098431 A1* 5/2007 Sugiyama ..... 399/88
2008/0088077 A1* 4/2008 Fujita ..... 271/90
2008/0185773 A1* 8/2008 Yamamoto ..... 271/176
2009/0224467 A1 9/2009 Mori
2011/0217058 A1* 9/2011 Honda et al. ..... 399/43
2012/0001387 A1* 1/2012 Mutsuno ..... 271/298
2012/0063833 A1* 3/2012 Yanagida ..... 400/582

* cited by examiner

FIG.4

| SHEET TYPE | COUNT VALUE |
|---|---|
| PLAIN PAPER | +1 |
| CARDBOARD | +1.5 |
| ENVELOPE | +2 |

FIG.8

| PROCESSING ORDER | JOB NAME | JOB DETAILS | STATE |
|---|---|---|---|
| 1 | PRINT JOB | PLAIN PAPER: 40 SHEETS | EXECUTED |
| 2 | PRINT JOB | CARDBOARD: 40 SHEETS | QUEUED |
| 3 | PRINT JOB | PLAIN PAPER: 10 SHEETS | QUEUED |
| 4 | : | : | : |
| 5 | : | : | : |

SHEET EJECT DEVICE, FULLNESS DETECTING METHOD, AND COMPUTER-READABLE RECORDING MEDIUM

This application is a continuation application of and claims priority under 35 U.S.C. §120/121 to U.S. application Ser. No. 13/067,524 filed Jun. 7, 2011, which claims priority to 35 U.S.C. §119 from Japanese Patent Application No. 2010-145237, filed on Jun. 25, 2010 and from Japanese Patent Application No. 2011-090715 filed an Apr. 15, 2011, the contents of each of which are hereby incorporated herein by reference in their entirety and for all purposes.

BACKGROUND

1. Field of the Invention

Example embodiments relate to a sheet eject device, a fullness detecting method, and a computer-readable recording medium.

2. Description of the Related Art

In recent years, technologies relevant to multifunction peripherals (MFP) have advanced. For example, CPUs have become high performance, memories have become high capacity, communications have become high speed, and digital images have become high quality. Accordingly, in addition to functioning merely as a digital copier, an MFP may have various functions such as a fax machine, a printer, and a scanner connected to a network, and may be used in various situations in the user's environment.

An image forming apparatus such as a printer or an MFP as described above includes sheet eject trays for holding sheets that are ejected after undergoing a printing operation. A sheet that is ejected from a sheet eject outlet is held on this sheet eject tray until a user comes to collect it. A sheet eject tray is usually positioned below the sheet eject outlet of the main body of the MFP. Accordingly, if sheets are continuously ejected, the sheet eject outlet may be blocked. Thus, the number of sheets that can be held on the sheet eject tray is limited. If the sheet eject outlet becomes blocked as sheets are continuously ejected and accumulated on the sheet eject tray, no more sheets can be ejected, and a paper jam occurs near the sheet eject outlet.

Conventionally, as a method of preventing such a paper jam from occurring, a sensor is provided near the sheet eject outlet for detecting whether the sheet eject tray is filled with sheets. When it is detected that the sheet eject tray is filled with sheets (when sheet fullness is detected), the Printing/sheet ejecting process of the MFP is temporarily stopped.

Furthermore, there are cases where the sheet eject tray of the MFP can be moved up and down. In this case, when sheet fullness is detected (when it is detected that the sheet eject tray is filled with ejected sheets), the sheet eject tray is moved down to temporarily increase the number of sheets that can be held on the sheet eject tray. Accordingly, a paper jam is prevented from occurring.

Furthermore, there are cases where the MFP is provided with plural sheet eject trays. For example, it is assumed that the MFP has two sheet eject trays provided one above the other. In this case, even when the bottom sheet eject tray is specified, when the fullness detecting sensor detects that the bottom sheet eject tray is filled with sheets, a control operation is performed so that the sheets are ejected to the top sheet eject tray. Accordingly, a paper jam is prevented from occurring.

As a relevant technology, patent document 1 discloses an invention in which an eject sensor and a fullness detection sensor are implemented by a common component. The movement of a filler used for detection is devised so that the component operates as an eject sensor under regular conditions, and when the sheet eject tray is filled with sheets and the angle of the filler changes, the component operates as a fullness detection sensor.

However, in the conventional technology, the fullness detection sensor is implemented by a physical mechanism. Therefore, there have been various issues in applying the fullness detection sensor to a low-cost, slim-type MFP. For example, the fullness detection sensor requires component costs and mounting costs, which are disadvantageous in terms of achieving a low-cost machine. Furthermore, the fullness detection sensor is mounted as a physical mechanism, and therefore a predetermined space is required in the MFP main unit for providing the fullness detection sensor including an operating part and a sensor part. In order to achieve a slim-type machine, even such a small space is preferably reduced.

In the invention of patent document 1, the eject sensor and the fullness detection sensor are implemented by a common component, and therefore it is unnecessary to provide an additional fullness detection sensor. Accordingly, costs and space can be reduced in this respect. However, the filler used in the sensor of the invention of patent document 1 is larger than that of a conventional sensor used only for detecting ejection. In this respect, the cost and space of the eject sensor is increased in the invention of patent document 1.

Patent Document 1: Japanese Laid-Open Patent Publication No. 2003-192225

SUMMARY

Example embodiments provide a sheet eject device, a fullness detecting method, and a computer-readable recording medium, in which one or more of the above-described disadvantages are eliminated.

An example embodiment provides a sheet eject device, a fullness detecting method, and a computer-readable recording medium, with which it can be detected whether a sheet eject tray is filled with sheets, without requiring a physical mechanism such as a fullness detecting sensor.

According to an aspect of example embodiments, there is provided a sheet eject device for detecting whether a sheet eject tray is filled with ejected sheets, the sheet eject device including an ejecting unit that ejects sheets onto the sheet eject tray; a counting unit that counts an accumulated eject number every time a sheet is ejected by the ejecting unit; a storing unit that stores a defined eject number threshold and a defined eject interval time; a fullness detecting unit that detects that the sheet eject tray is filled with ejected sheets when the accumulated eject number counted by the counting unit exceeds the defined eject number threshold; and a reset unit that resets the accumulated eject number counted by the counting unit when an eject interval time exceeds the defined eject interval time the eject interval time extending from when one sheet is ejected until a next sheet is ejected by the ejecting unit.

According to an aspect of example embodiments, there is provided a fullness detecting method performed in a sheet eject device for detecting whether a sheet eject tray is filled with ejected sheets, the fullness detecting method including ejecting sheets onto the sheet eject tray; counting an accumulated eject number every time a sheet is ejected; storing a defined eject number threshold and a defined eject interval time; detecting that the sheet eject tray is filled with ejected sheets when the accumulated eject number counted at the counting exceeds the defined eject number threshold; and resetting the accumulated eject number counted at the counting when an eject interval time exceeds the defined eject interval time, the eject interval time extending from when one sheet is ejected until a next sheet is ejected at the ejecting.

BRIEF DESCRIPTION OF THE DRAWINGS

Other objects, features and advantages of the present invention will become more apparent from the following detailed description when read in conjunction with the accompanying drawings, in which:

FIG. 4 is an example of a sheet type count value table;

FIG. 8 indicates an example of a job list; and

DETAILED DESCRIPTION OF EXAMPLE EMBODIMENTS

A description is given, with reference to the accompanying drawings, of embodiments of the present invention. In the following embodiments, a sheet eject device according to an embodiment of the present invention is applied to an image forming apparatus. The image forming apparatus may have an external sheet eject device or a built-in sheet eject device.

System Configuration

Hardware

Figure 1:
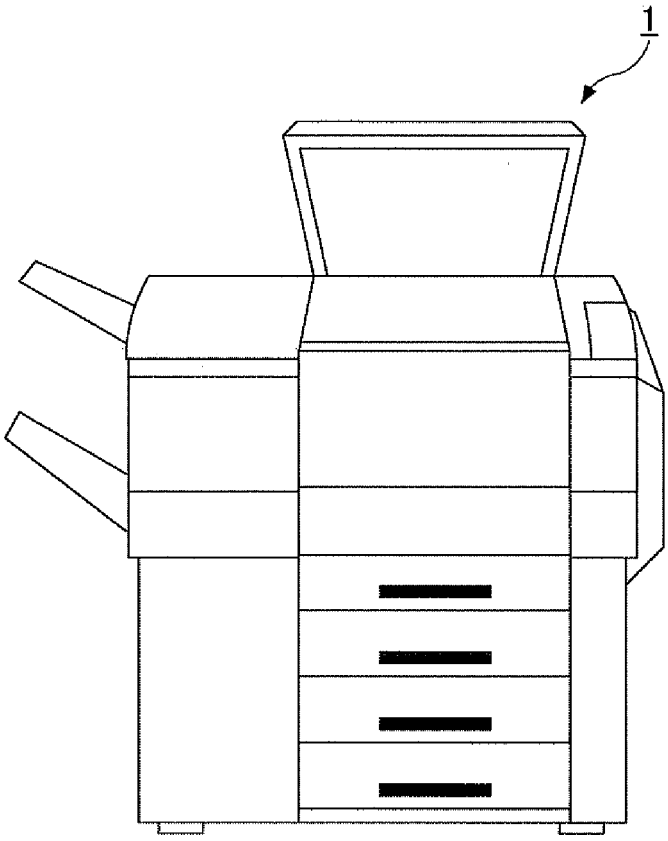
FIG. 1 illustrates an example of the exterior appearance of an image forming apparatus according to an example embodiment.

A description is given of a hardware configuration of an image forming apparatus 1. FIG. 1 illustrates an example of the exterior appearance of the image forming apparatus 1 according to the Present embodiment. FIG. 1 indicates an example of an MFP; however, the present invention is applicable to, for example, a printer device including an eject mechanism for ejecting sheets and an eject tray for holding (receiving) the ejected sheets.

Figure 2:
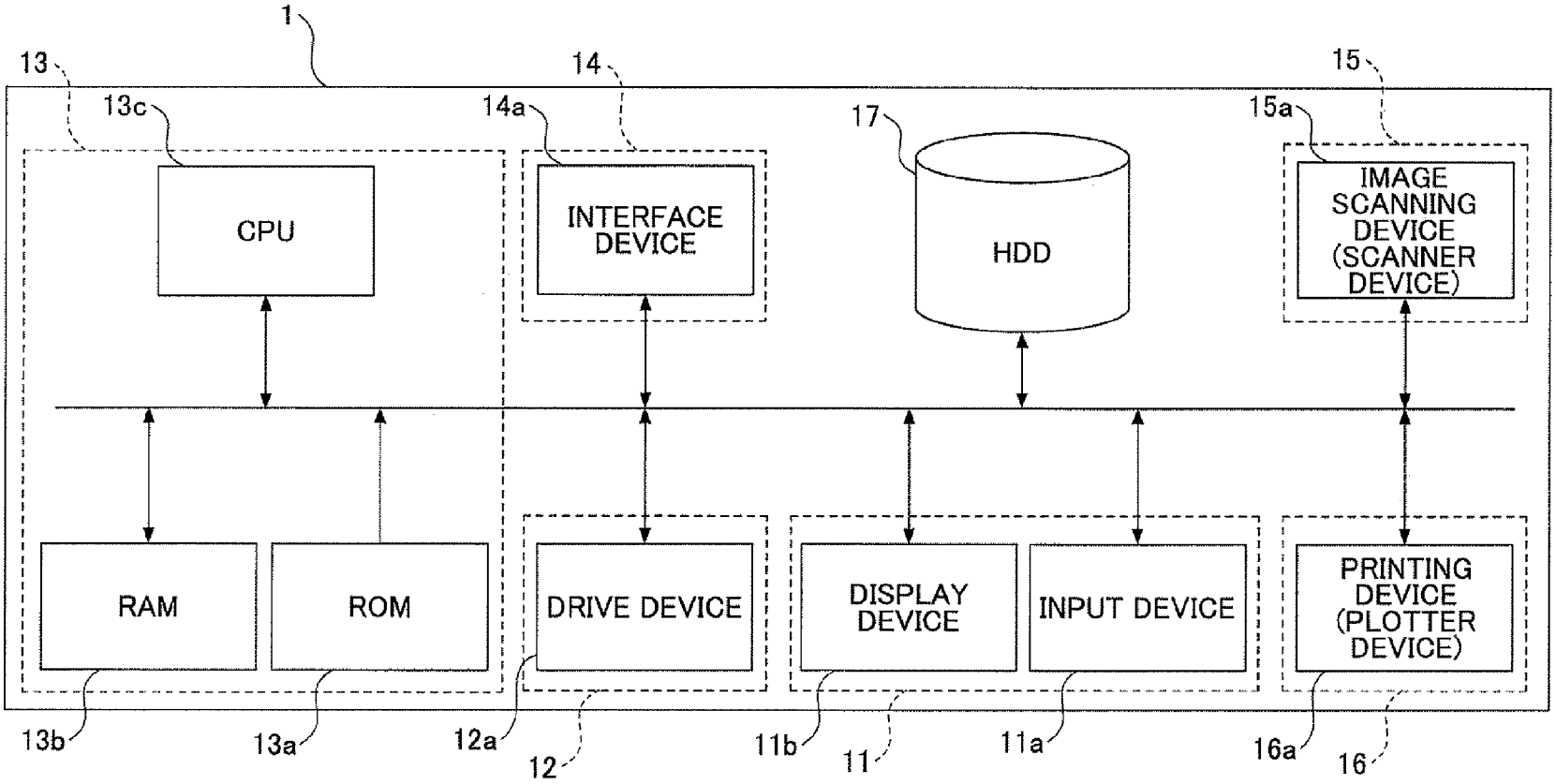
FIG. 2 illustrates an example of a hardware configuration of the image forming apparatus according to an example embodiment.

FIG. 2 illustrates an example of a hardware configuration of the image forming apparatus 1 according to the present embodiment. The image forming apparatus 1 according to the present embodiment includes an operations panel 11, a storage media I/F 12, a controller 13, a data communications I/F 14, a scanner 15, a plotter 16, and a HDD (Hard Disk Drive) 17, which are interconnected to each other.

The operations panel 11 includes an input device 11*a* and a display device 11*b*. The input device 11*a* includes hard keys, and is used for entering various operation signals into the apparatus body. Furthermore, the display device 11*b* includes a display, and is used for displaying various information items relevant to image forming operations, for example. The data communications I/F 14 includes an interface device 14*a*, which is for connecting the image forming apparatus 1 to a network and a data transmission line such as a fax transmission line. The HDD 17 stores various types of data, such as data of received documents and data of scanned images handled by the image forming apparatus 1, and data used by various applications. Furthermore, the HDD 17 manages these various types of data with a predetermined file system and a DB (Data Base).

Various types of data stored in the HDD 17 include data input from a recording medium. A storage medium is set in a drive device 12*a* included in the storage media I/F 12, and data is loaded from the storage medium into the HDD 17 via the drive device 12*a*.

The controller 13 includes a ROM (Read Only Memory) 13*a*, a RAM (Random Access Memory) 13*b*, and a CPU (Central Processing Unit) 13*c*. The ROM 13*a* stores programs executed when the image forming apparatus 1 is activated, and various types of data. Furthermore, the RAM 13*b* temporarily holds various programs and data read from the ROM 13*a* and the HDD 17. The CPU 13*c* executes the programs temporarily held by the RAM 13*b*. For example, when print data is received via the data communications I/F 14, the controller 13 executes, with the CPU 13*c*, a program (PDL parser) that can interpret PDL (Page Description Language) loaded in the RAM 13*b* from the ROM 13*a*, and interprets the print data to generate a bitmap image.

The scanner 15 includes an image scanning device 15*a*, and optically scans an original document placed on a scan surface and generates image data. The plotter 16 includes a printing device 16*a*, and prints a bitmap image onto a recording sheet by an electrophotographic method.

As described above, the image forming apparatus 1 implements functions relevant to image forming operations such as copying, scanning, printing, and fax transmission by the above hardware configuration.

Functions

Figure 3:
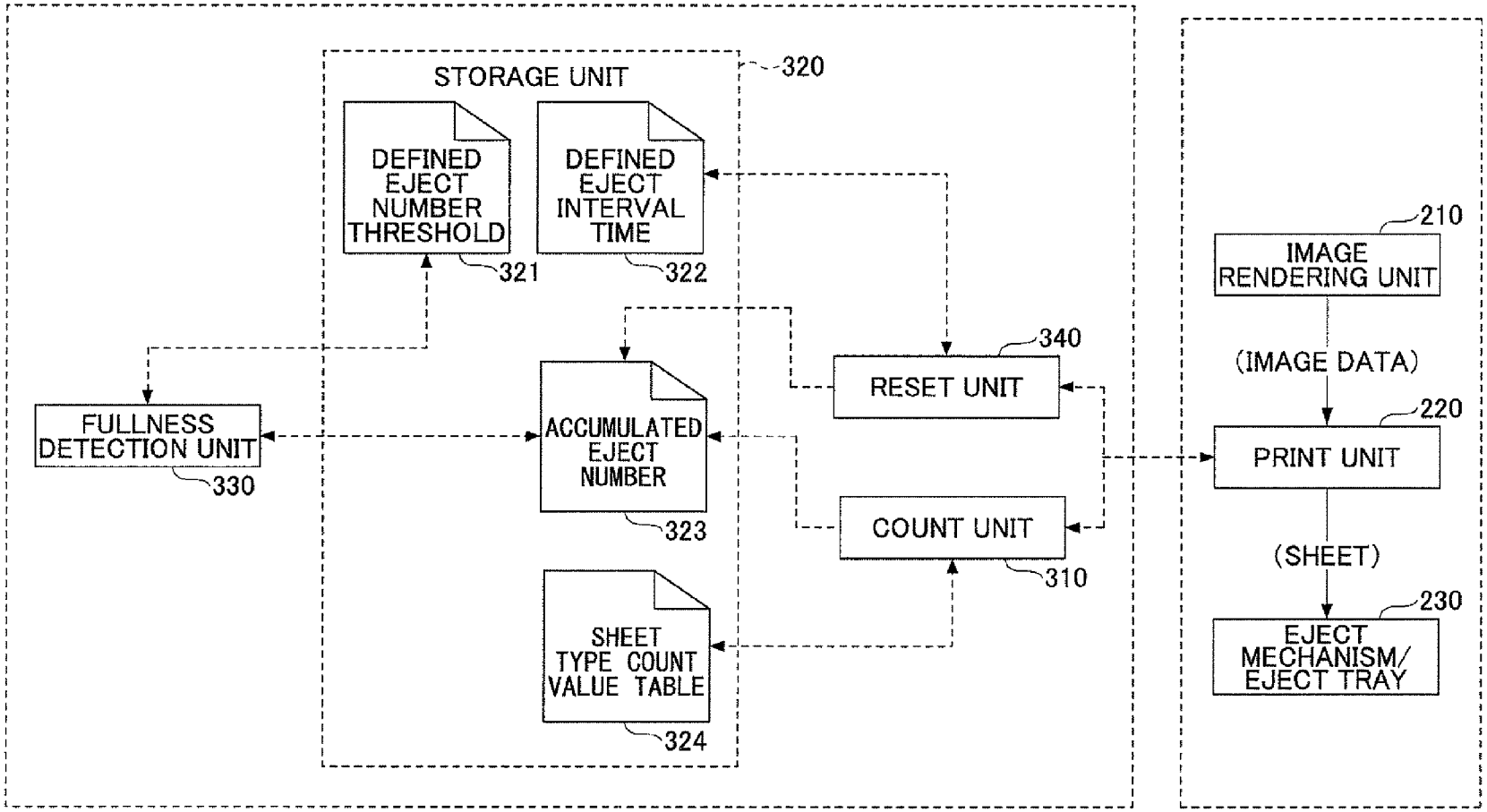
FIG. 3 is a functional block diagram indicating the main functions of the image forming apparatus according to an example embodiment.

Next, a brief description is given of the main functional configuration of the image forming apparatus 1 according to the present embodiment. FIG. 3 is a functional block diagram indicating the main functions of the image forming apparatus 1 according to the present embodiment. Main functions of the image forming apparatus 1 include an image rendering unit 210, a print unit 220, an eject mechanism/eject tray 230, a count unit 310, a storage unit 320, a fullness detection unit 330, and a reset unit 340. These functions are described briefly in this section, and more details are given below.

The image rendering unit 210 renders a bitmap image based on results of interpreting printer language for print data. This function corresponds to the function of the controller 13.

The print unit 220 includes a printer engine I/F and a printer engine. When a print request is received, the print unit 220 prints a rendered bitmap image onto a recording sheet by, for example, an electrophotographic method. This function corresponds to the function of the plotter 16.

The eject mechanism/eject tray 230 includes an eject mechanism and a sheet eject tray for ejecting a sheet on which an image has been printed and holding the sheet. A sheet ejected from the sheet eject outlet is held on this sheet eject tray until a user comes to collect it. This function is included in the function of the plotter 16.

The count unit 310 has a function of counting an accumulated eject number 323 every time a sheet is ejected from the eject mechanism/eject tray 230. Furthermore, the count unit 310 determines the type of ejected sheet, and increments the accumulated eject number 323 by a count value specified according to the sheet type, based on count values set for different sheet types (sheet type count value table 324).

The storage unit 320 is a memory for holding various parameters and values. In the present embodiment, the storage unit 320 stores a defined eject number threshold 321, a defined eject interval time 322, the accumulated eject number 323, and the sheet type count value table 324. Details are given below.

The fullness detection unit 330 detects that the sheet eject tray is filled with ejected sheets when the accumulated eject number 323 counted by the count unit 310 exceeds the defined eject number threshold 321.

The reset unit 340 counts (measures) the eject interval time from when one sheet is ejected until the next sheet is ejected. When the eject interval time from when one sheet is ejected until the next sheet is ejected from the eject mechanism/eject tray 230 exceeds the defined eject interval time 322, the reset unit 340 resets the counted accumulated eject number 323.

The above functions are actually implemented by a computer, which is caused to perform these functions as programs are executed by the CPU 13*c* of the image forming apparatus 1.

Various Parameters

The storage unit 320 holds the defined eject number threshold 321, the defined eject interval time 322, the accumulated eject number 323, and the sheet type count value table 324.

Accumulated Eject Number

The accumulated eject number 323 is the accumulated number of sheets counted every time a sheet is ejected from the sheet eject outlet. For example, when ten sheets are ejected, and then another one hundred sheets are ejected, the accumulated eject number 323 is 110 sheets. The accumulated eject number 323 is reset (initial value=0) under a predetermined condition.

Defined Eject Number Threshold

The defined eject number threshold 321 is a defined number of sheets at which no more sheets can be ejected on the sheet eject tray after sheets have been continuously ejected. The defined eject number threshold 321 is known information that is given in advance, but the defined eject number threshold 321 may also be set to any number by operating the operations panel 11. However, the defined eject number threshold 321 is a threshold defining how many sheets can be held (or cannot be held) on the sheet eject tray, and therefore the defined eject number threshold 321 needs to be determined in consideration of the height from the sheet eject tray to the sheet eject outlet and the thickness of the sheets.

For example, assuming that the height from the sheet eject tray to the sheet eject outlet is 45 mm, and a plain paper sheet is 0.08 mm, it can be simply calculated that a maximum of approximately 562 Plain paper sheets can be held on the sheet eject tray. In this case, the defined eject number threshold 321 can be simply set to 562 sheets. However, in reality, the thickness of adhered toner is approximately 0.04 mm, the space between sheets is approximately 0.02 mm, and the sheet bends when ejected by approximately 25 mm. Therefore, these factors also need to be considered in determining the final defined eject number threshold 321.

In this example, the height from the sheet eject tray to the sheet eject outlet is 45 mm. The maximum height of the stack of sheets placed on the sheet eject tray is set to be 25 mm, considering that the sheets bend when ejected. In the case of plain paper sheets, the maximum number of sheets that can be placed on the sheet eject tray is obtained as follows, in consideration of the thickness of adhered toner and spaces between sheets.

$$25/(0.08+0.04+0.02) \approx \text{approximately 178 sheets}$$

Accordingly, in this example, the defined eject number threshold 321 is defined as 150 sheets in the case of plain paper, in consideration of errors.

Defined Eject Interval Time

The defined eject interval time 322 is the time taken from when one sheet is ejected from the sheet eject outlet to the sheet eject tray until the next sheet is ejected from the sheet eject outlet to the sheet eject tray. The defined eject interval time 322 is a value used as a condition for resetting the accumulated eject number 323. When the eject interval time from when one sheet is ejected from the sheet eject outlet until the next sheet is ejected from the sheet eject outlet exceeds the defined eject interval time 322, the counted accumulated eject number 323 is reset.

The defined eject interval time 322 is known information that is given in advance, but the defined eject interval time 322 may also be set to any value by operating the operations panel 11. In this example, the defined eject interval time 322 is defined as five seconds, in consideration of the printing process speed of the image forming apparatus 1. When a print instruction for plural sheets is given for a print job A, the sheets are continuously ejected within intervals of five seconds from when one sheet is ejected until the next sheet is ejected. Accordingly, the accumulated eject number 323 is continuously counted and accumulated without being reset.

Furthermore, assuming that a next print job B is continuously queued up, the first sheet of print job B is ejected within five seconds from when the previous print job A is completed. Similarly, assuming that a next print job C is continuously queued up, the first sheet of print job C is ejected within five seconds from when the previous print job B is completed, and so on. Accordingly, the accumulated eject number 323 is continuously counted and accumulated without being reset. Meanwhile, when a next print job B is not queued up after print job A, the printing and ejecting operations stop for a while until a next print job B is instructed. For example, the printing and ejecting operations stop for more than five seconds, and therefore the accumulated eject number 323 is reset. That is to say, as long as print jobs are continuously executed within five seconds, the accumulated eject number 323 is continuously counted and accumulated without being reset.

The sheet type count value table 324 is a table including count values defined for different sheet types. The sheet type count value table 324 is known information determined based on the thickness of the sheet types. The count unit 310 determines the type of ejected sheet and increments the accumulated eject number 323 by a count value defined according to the sheet type, based on the determined sheet type and the count value defined for each sheet type (sheet type count value table 324). In the case of plain paper sheets, the defined eject number threshold 321 is defined as 150 sheets in the above example; however, the image forming apparatus 1 may handle several sheet types having different thicknesses. Therefore, as the thickness of the sheet increases, the accumulated eject number 323 needs to be incremented by a larger count number.

According to the above calculation, 150 plain paper sheets can be placed on the sheet eject tray (more precisely 178 sheets). However, in the case of cardboard and envelopes that are thicker than plain paper sheets, the maximum number of sheets that can be placed on the sheet eject tray is less than 150 sheets (more precisely 178 sheets). Accordingly, the count value for plain paper sheets is defined as one, and the count values of different sheet types such as cardboard are calculated according to the difference between the thickness of plain paper and the thickness of a different sheet type such as cardboard. Thus, the maximum number of sheets can be counted in units of plain paper, even when various types of sheets are ejected to the sheet eject tray.

FIG. 4 is an example of the sheet type count value table 324. The count values are determined in proportion to the thicknesses of various sheet types, by using the thickness of a plain paper sheet 0.08 mm as a reference. As a matter of simplification, the count values of various sheet types are defined as indicated in FIG. 4. For example, when one cardboard sheet is ejected, it is considered that 1.5 plain paper sheets are ejected, and the accumulated eject number 323 is incremented by 1.5. In another example, when one envelope (made of paper) is ejected, it is considered that two plain paper sheets are ejected, and the accumulated eject number 323 is incremented by two. As a matter of course, when one plain paper sheet is ejected, it is considered that one plain paper sheet is ejected, and the accumulated eject number 323 is incremented by one.

Information Processing

Figure 5:
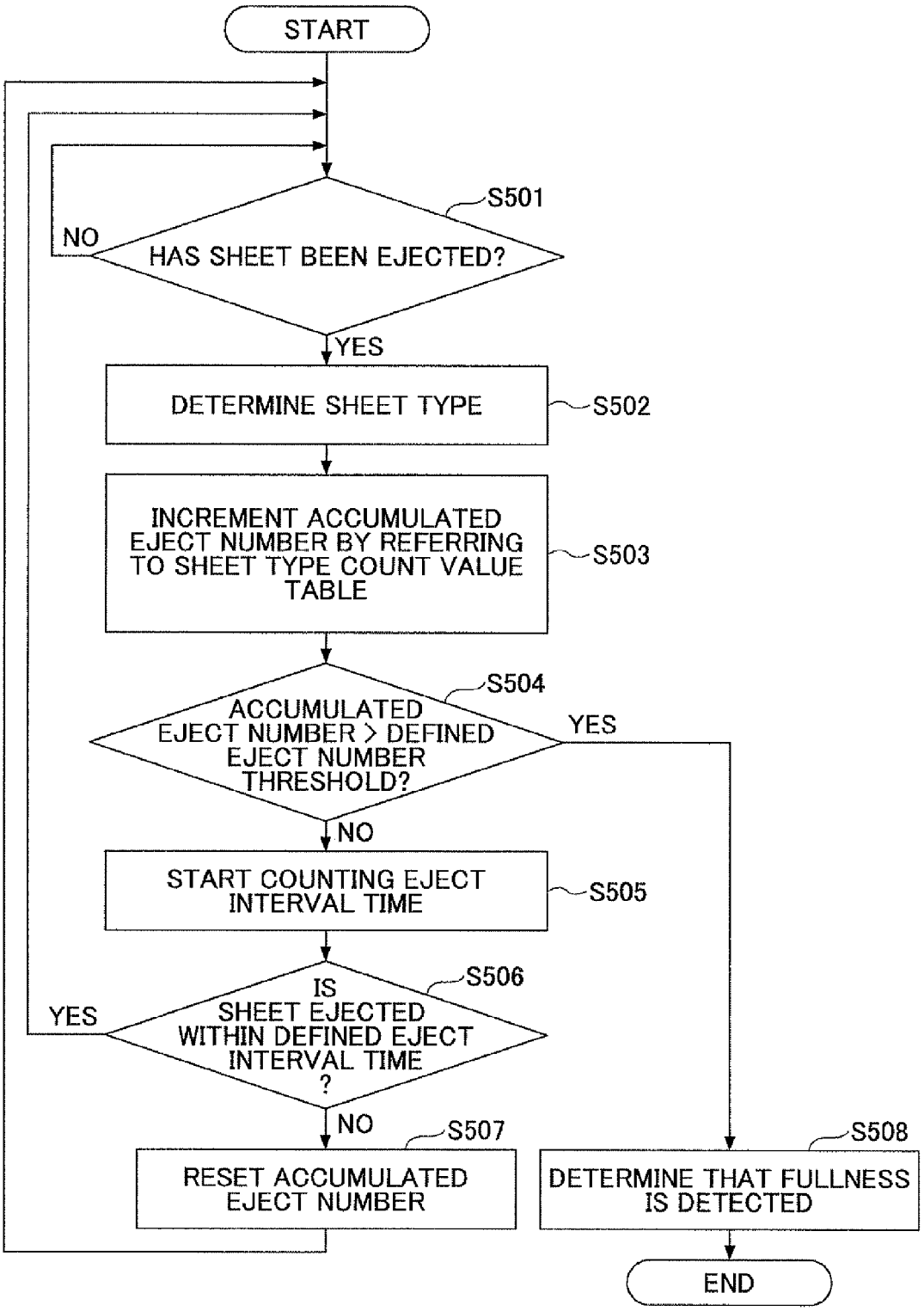
FIG. 5 is a sequence diagram for describing a method of detecting fullness in the image forming apparatus.

FIG. 5 is a sequence diagram for describing the method of detecting fullness in the image forming apparatus 1. The following description is made with reference to FIG. 5.

First, it is determined whether a sheet has been ejected (step S501). It may be determined whether a sheet has been ejected based on various factors. Furthermore, the determination of the sheet type needs to be considered as well. For example, a print job (including printing conditions and image data) is sent to the print unit 220 (engine I/F), and therefore information relevant to the number of sheets to be printed and the sheet type can be recognized by acquiring the print job. This may also be recognized based on information entered in the operations panel 11 by the user. Furthermore, when the print unit 220 completes printing, the print unit 220 sends an eject instruction to the eject mechanism/eject tray 230, and therefore the above information may be recognized according to the eject instruction. Alternatively, the above information may be recognized by the controller 13 (in a case where the controller 13 is provided with the fullness detection function according to the present invention), as the controller 13 controls operations of all function units. It may be determined whether a sheet has been ejected based on various factors, according to the configuration and the design of the image forming apparatus 1.

When a sheet is ejected, the count unit 310 determines the type of sheet (step S502). The method of determining the sheet type may be performed according to the configuration and the design of the image forming apparatus 1 as described above.

Next, the count unit 310 refers to the sheet type count value table 324, and increments the accumulated eject number 323 by a value in accordance with the sheet type (step S503).

The fullness detection unit 330 compares the accumulated eject number 323 with the defined eject number threshold 321, and determines whether the accumulated eject number 323 has exceeded the defined eject number threshold 321 (step S504). When the accumulated eject number 323 is determined to be exceeding the defined eject number threshold 321, it is determined (detected) that the sheet eject tray is filled with ejected sheets (step S508).

Meanwhile, when the accumulated eject number 323 is determined not to be exceeding the defined eject number threshold 321, the reset unit 340 starts counting the sheet eject interval (step S505). When a new sheet is ejected within the defined eject interval time 322 (step S506), the process returns to step S501, and steps S501 through S504 are repeated.

Meanwhile, when a new sheet is not ejected within the defined eject interval time 322, the reset unit 340 resets (initializes) the accumulated eject number 323 (step S507). That is to say, when the defined eject interval time 322 passes without a new sheet being ejected, the accumulated eject number 323 is reset.

In step S508, when it is determined (detected) that the sheet eject tray is filled with ejected sheets, control operations performed when fullness is detected are to be subsequently executed. For example, similar to a case where a conventional fullness detection sensor detects fullness, the printing/ejecting process of the MFP is temporarily interrupted (stopped), or the sheet eject tray is moved down if each sheet eject tray can be separately moved up and down. Furthermore, the number of sheets that can be held on the sheet eject tray may be temporarily increased. Furthermore, when there are two sheet eject trays provided one above the other, the sheet eject trays may be moved so that sheets are ejected to the other tray. Accordingly, a paper jam can be prevented from occurring.

In step S508, when it is determined (detected) that the sheet eject tray is filled with ejected sheets, a message that the sheet eject tray is filled with ejected sheets may be reported/displayed on the display (display device 11*b*) of the image forming apparatus 1, so that subsequent operations may be entered.

Figure 6:
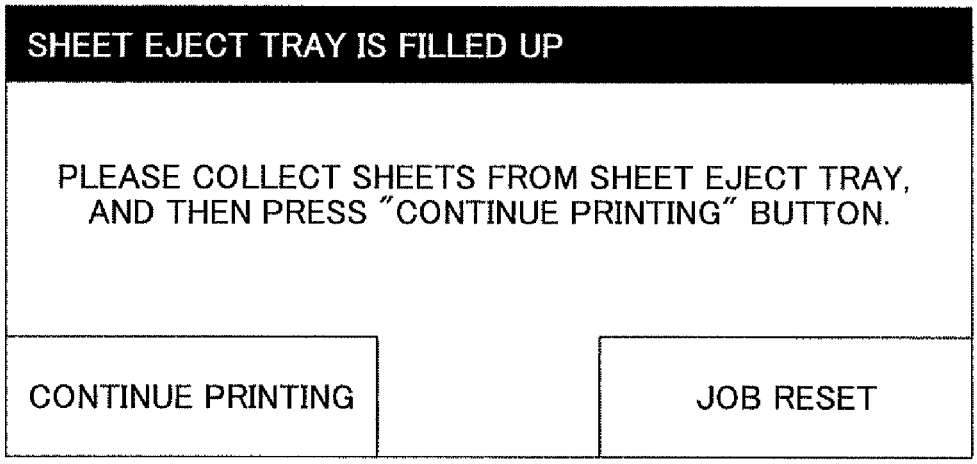
FIG. 6 illustrates an example of a display screen page when fullness is detected.

FIG. 6 illustrates an example of a display screen page when fullness is detected. The user confirms the message on the display screen page, and enters an operation of "continue printing," or "job reset". When "continue printing" is pressed, the fullness detection state of the sheet eject tray is released, and the image forming apparatus 1 resumes the printing operation that has been interrupted. When "job reset" is pressed, the subsequent printing operations are cancelled.

Example 1

Based on the above descriptions, the fullness detection operation according to the present embodiment is described. In this example, the preconditions are as follows.

Defined eject number threshold: 150 sheets (in units of plain paper)

Defined eject interval time: 5 seconds

Sheet type count value table: as illustrated in FIG. 4

It is assumed that a print job for printing on 200 plain paper sheets is instructed by a user, in the image forming apparatus 1 according to the present embodiment. In this case, every time a sheet is printed and ejected, the sheet type is determined. The sheet type is plain paper, and therefore every time a sheet is ejected, the accumulated eject number 323 is incremented by one. When the accumulated eject number 323 reaches 151, it is determined that the accumulated eject number 323 has exceeded the defined eject number threshold 321, and therefore it is determined (detected) that the sheet eject tray is filled with ejected sheets. Subsequently, control operations performed when fullness is detected are executed to prevent a paper jam from occurring.

In this example, a printing job has been instructed for printing on 200 plain paper sheets, even though the maximum number of plain paper sheets that can be held on the sheet eject tray is 150. However, even when the maximum number of sheets that can be held on the sheet eject tray is actually ejected on the sheet eject tray, a paper jam can be prevented from occurring by detecting fullness (and executing control operations performed when fullness is detected).

Example 2

In this example, the preconditions are as follows.

Defined eject number threshold: 150 sheets (in units of plain paper)

Defined eject interval time: 5 seconds

Sheet type count value table: as illustrated in FIG. 4

It is assumed that a print job for printing on 200 cardboard sheets is instructed by a user, in the image forming apparatus 1 according to the Present embodiment. In this case, every time a sheet is printed and ejected, the sheet type is determined. The sheet type is cardboard, and therefore every time a sheet is ejected, the accumulated eject number 323 is incremented by 1.5. When the accumulated eject number 323 reaches 101, it is determined that the accumulated eject number 323 has exceeded the defined eject number threshold 321, and therefore it is determined (detected) that the sheet eject tray is filled with ejected sheets. Subsequently, control operations performed when fullness is detected are executed to prevent a paper jam from occurring.

In this example, a printing job has been instructed for printing on 200 cardboard sheets, even though the maximum number of cardboard sheets that can be held on the sheet eject tray is 100. However, even when the maximum number of sheets (maximum sheet quantity) that can be held on the sheet eject tray is actually ejected on the sheet eject tray, a paper jam can be prevented from occurring by detecting fullness (and executing control operations performed when fullness is detected).

Example 3

In this example, the preconditions are as follows.

Defined eject number threshold: 150 sheets (in units of plain paper)

Defined eject interval time: 5 seconds

Sheet type count value table: as illustrated in FIG. 4

It is assumed that a print job for printing on 40 plain paper sheets is instructed by a user, in the image forming apparatus 1 according to the present embodiment. In this case, every time a sheet is printed and ejected, the sheet type is determined. The sheet type is plain paper, and therefore every time a sheet is ejected, the accumulated eject number 323 is incremented by one. The accumulated eject number 323 is 40, when printing on 40 plain paper sheets is completed and the 40 plain paper sheets are ejected.

It is assumed that a print job for printing on 40 cardboard sheets is instructed while the 40 Plain paper sheets are being printed (i.e., a print job is stored in a job queue). Accordingly, after printing on 40 plain paper sheets is completed, 40 cardboard sheets are subsequently printed. Every time a sheet is printed and ejected, the sheet type is determined. The sheet type is cardboard, and therefore every time a sheet is ejected, the accumulated eject number 323 is incremented by 1.5. By converting the number of cardboard sheets to units of plain paper sheets, the number of printed sheets corresponds to 60 sheets. Therefore, the accumulated eject number 323 amounts to 100, when 40 cardboard sheets are ejected.

Furthermore, it is assumed that a print job for printing on 10 plain paper sheets is instructed while the 40 plain paper sheets and the 40 cardboard sheets are being printed. Every time a sheet is printed and ejected, the sheet type is determined. The sheet type is plain paper, and therefore every time a sheet is ejected, the accumulated eject number 323 is incremented by one. Therefore, the accumulated eject number 323 amounts to 110, when the 10 plain paper sheets are ejected.

When print jobs are consecutively instructed one after the other, sheets are ejected before the defined eject interval time 322 (5 seconds) passes. Therefore, the accumulated eject number 323 reaches the defined eject number threshold 321 (150 sheets) without being reset, and it is determined (detected) that the sheet eject tray is filled with ejected sheets.

In this example, the print jobs are consecutively instructed one after the other, without the user collecting the ejected sheets from the sheet eject tray. Therefore, it is determined that the sheet eject tray becomes filled with ejected sheets. However, if the user keeps collecting the ejected sheets from the sheet eject tray during the consecutively instructed print jobs, the sheet eject tray may not actually be filled with sheets (there is a margin), even when the accumulated eject number 323 reaches 150 and it is detected (determined) that the sheet eject tray is filled with ejected sheets. However, if the user does not collect any ejected sheets from the sheet eject tray, the sheet eject tray actually becomes filled with ejected sheets. Thus, by defining the defined eject interval time 322 as five seconds, and counting the accumulated number of ejected sheets when printing is continuously performed in consideration of a busiest period where print jobs are consecutively instructed, it is possible to prevent a paper jam from occurring under worst conditions (i.e., when none of the ejected sheets are collected by the user).

The defined eject interval time 322 is set at five seconds (or less) in consideration of a busiest period where print jobs are consecutively executed without interruptions. However, even during a busiest period, there may be a case where an interruption occurs between print jobs. In this case, the sheet eject interval time exceeds five seconds, and therefore the accumulated eject number 323 is reset. Nevertheless, if the user does not collect any sheets from the sheet eject tray, the following failure may occur. That is, even if the sheet eject tray is actually filled with ejected sheets, it cannot be detected that the sheet eject tray is filled, because the accumulated eject number 323 does not reach the defined eject number threshold 321. Accordingly, by setting a long defined eject interval time 322 (for example, approximately 30 seconds to one minute), even if print jobs are slightly interrupted, the accumulated eject number 323 can be prevented from being reset. Thus, even under worst conditions where the user does not collect any sheets from the sheet eject tray, it can be detected that the sheet eject tray is filled when the sheet eject tray is actually filled. As described above, by appropriately adjusting and setting the defined eject interval time, the Precision of fullness detection can be improved.

Furthermore, in the above description, fullness is detected in consideration of worst conditions where the user does not collect any sheets from the sheet eject tray. However, assuming that the user collects a moderate amount of sheets, the defined eject number threshold 321 may be set at a relatively large value (for example, 200 sheets). In reality, the sheet eject tray becomes full at 150 sheets. However, it is assumed that the user collects a certain number of sheets (in this case, 50 sheets). Therefore, it is determined (detected) that the sheet eject tray is filled with ejected sheets when the accumulated eject number 323 reaches 200, in consideration of the collected sheets. If the user collects 50 sheets as anticipated, it is determined that fullness is detected when the accumulated eject number 323 reaches 200, when there are actually 150 ejected sheets on the sheet eject tray. As described above, by appropriately adjusting and setting the defined eject number threshold 321, the precision of fullness detection can be improved.

Modification

Next, a description is given of a modification of the above embodiment. The present modification is different from the above embodiment in the method of determining to reset the accumulated eject number 323 that is incremented every time a sheet is ejected. In the above embodiment, the reset unit 340 counts (measures) the eject interval time from when one sheet is ejected until the next sheet is ejected. When the eject interval time, which is from when one sheet is ejected until the next sheet is ejected by the eject mechanism/eject tray 230, exceeds the defined eject interval time 322, the counted accumulated eject number 323 is reset.

Meanwhile, in the present modification, the reset unit 340 refers to a job list (job queue), determines whether there is a print job queued up (reserved) after the print job that is currently being executed, and resets the accumulated eject number 323 based on the determination result. During the business period, it is assumed that print jobs are consecutively instructed such that the operation of the image forming apparatus 1 is uninterrupted. In the present modification, while the present print job is being executed, the reset unit 340 refers to the jab list (job queue). When no other print jobs are queued up (reserved), i.e., when print jobs are not consecutively instructed, the reset unit 340 resets the accumulated eject number 323. Meanwhile, when the reset unit 340 refers to the job list (job queue) and there is another print job queued up (reserved), i.e., when print jobs are consecutively instructed, the reset unit 340 continues to count the accumulated eject number 323. Then, when it is determined that the accumulated eject number 323 has exceeded the defined eject number threshold 321, it is determined (detected) that the sheet eject tray is filled with ejected sheets. Subsequently, control operations performed when fullness is detected are executed to prevent a paper jam from occurring.

Functions

Figure 7:
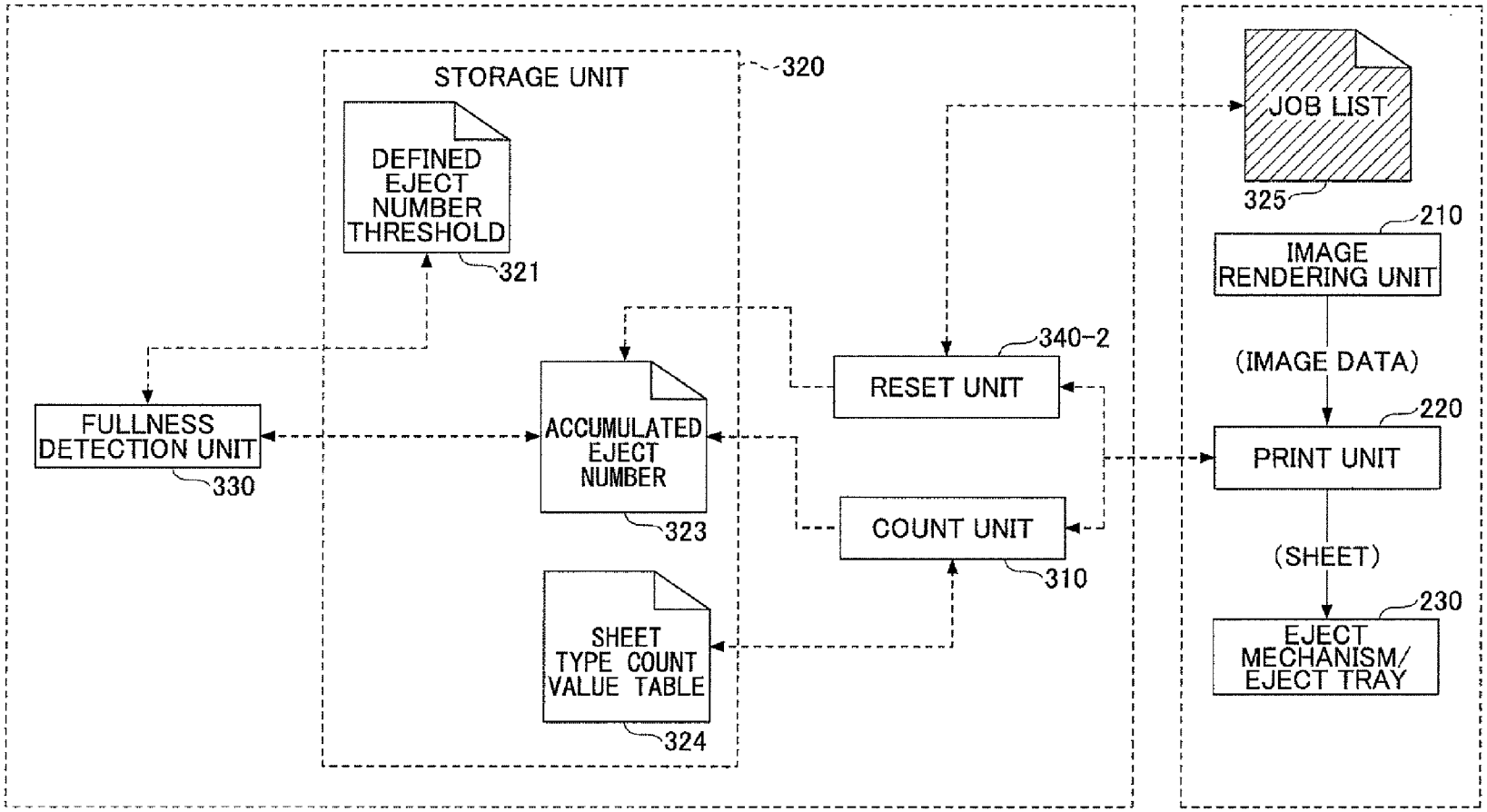
FIG. 7 is a functional block diagram indicating the main functions of the image forming apparatus according to a modification of an example embodiment.

FIG. 7 is a functional block diagram indicating the main functions of the image forming apparatus 1 according to the modification of the present embodiment. The difference between FIG. 7 and FIG. 3 is that in FIG. 7, the defined eject interval time 322 is removed, and a job list 325 is added instead. The function of the reset unit 340 of FIG. 3 is modified, and is thus denoted by 340-2 in FIG. 7.

Job List

FIG. 8 indicates an example of the job list 325. The job list 325 is a so called job queue, in which print jobs instructed (reserved) in the image forming apparatus 1 are registered in a list format. As a matter of course, the order of executing print jobs may be changed when interrupted by an additional job. However, in principle, the jobs are sequentially executed in the order they were instructed (first in, first out). In the example of the job list 325 of FIG. 8, at least three print jobs are instructed, and the print jobs are executed in the order of the print job currently executed (plain paper: 40 sheets), the next queued up print job (cardboard: 40 sheets), and then the next queued up print job (Plain paper: 10 sheets).

The print jobs in the job list 325 can be managed according to the configuration and design of the image forming apparatus 1, as described above. For example, a print job (including printing conditions and image data) is sent to the print unit 220 (engine I/F), and therefore the print job (information relevant to the number of sheets to be printed and the sheet type) can be recognized by acquiring the print job. This may also be recognized based on information entered in the operations panel 11 by the user. Furthermore, when the print unit 220 completes printing, the print unit 220 sends an eject instruction to the eject mechanism/eject tray 230, and therefore the above information may be recognized according to the eject instruction. Alternatively, the above information may be recognized by the controller 13, as the controller 13 controls operations of all function units.

Information Processing

Figure 9:
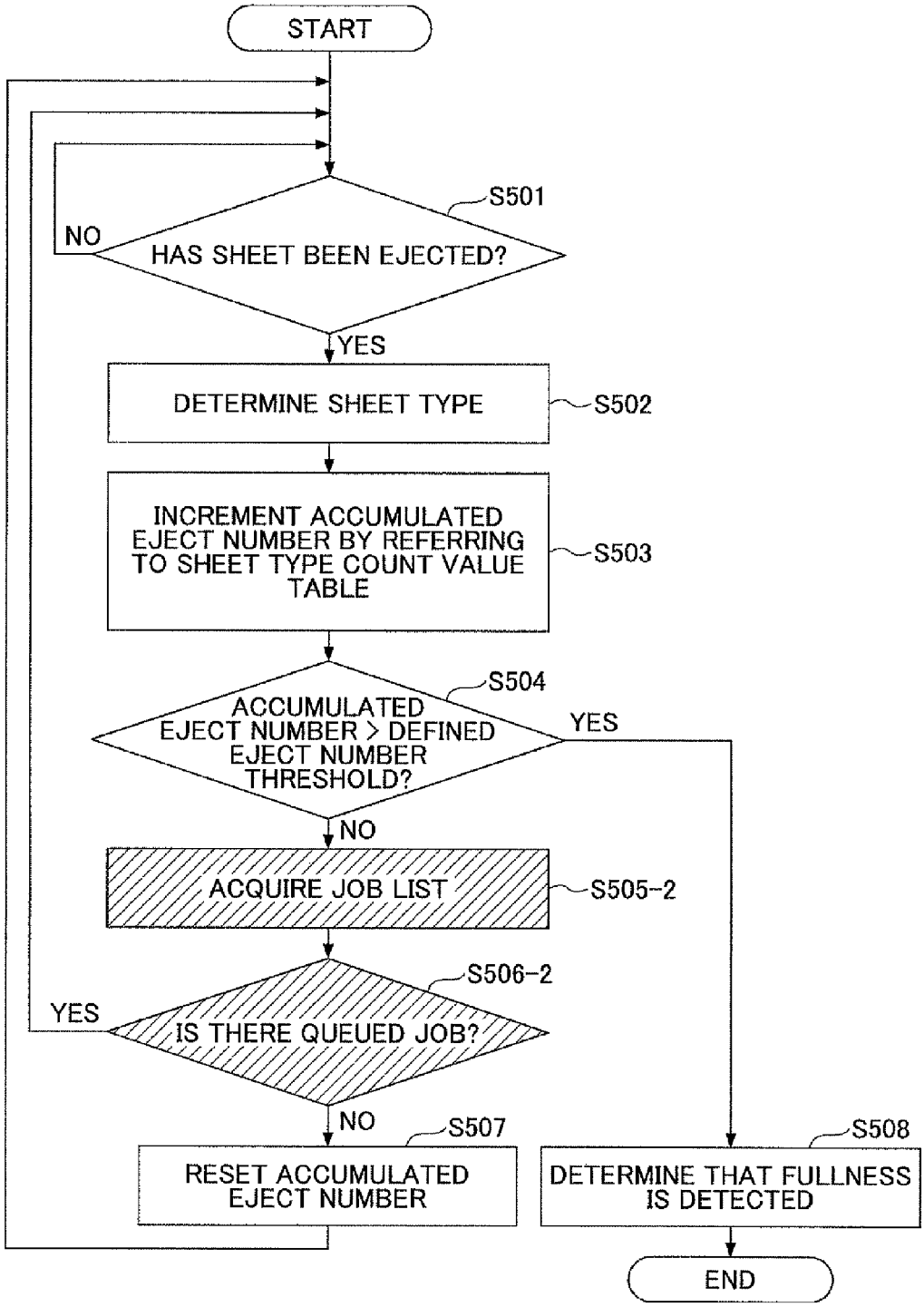
FIG. 9 is a sequence diagram for describing a method of detecting fullness in the image forming apparatus according to an example modification.

FIG. 9 is a sequence diagram for describing the method of detecting fullness in the image forming apparatus 1 according to the present modification. The following description is made with reference to FIG. 9. In FIG. 9, steps S505-2 and S506-2 are different from FIG. 5.

First, it is determined whether a sheet has been ejected (step S501). When a sheet is ejected, the count unit 310 determines the type of sheet (step S502). Next, the count unit 310 refers to the sheet type count value table 324, and increments the accumulated eject number 323 by a value in accordance with the sheet type (step S503).

The fullness detection unit 330 compares the accumulated eject number 323 with the defined eject number threshold 321, and determines whether the accumulated eject number 323 has exceeded the defined eject number threshold 321 (step S504). When the accumulated eject number 323 is determined to be exceeding the defined eject number threshold 321, it is determined (detected) that the sheet eject tray is filled with ejected sheets (step S508).

Meanwhile, when the fullness detection unit 330 determines that the accumulated eject number 323 has not exceeded the defined eject number threshold 321, the reset unit 340 acquires the job list 325 (step S505-2). The reset unit 340 refers to the acquired job list 325, and determines whether there is another print job queued up other than the print job currently being executed (step S506-2).

When the reset unit 340 determines that there is another print job queued up, the process returns to step S501, and steps S501 through S504 are repeated. That is to say, when there is another print job queued up other than the print job currently being executed, it means that print jobs are consecutively instructed, and therefore the accumulated eject number 323 is continuously incremented without being reset. In a busy period, print jobs are consecutively instructed and sheets are continuously ejected without resetting the accumulated eject number 323, and the sheet eject tray becomes filled. When the accumulated eject number 323 exceeds the defined eject number threshold 321, the fullness detection unit 330 detects that the sheet eject tray is filled with ejected sheets (step S508). Subsequently, control operations performed when fullness is detected are executed to prevent a paper jam from occurring.

Meanwhile, when it is determined that no print jobs are queued up other than the print job currently being executed, the reset unit 340 resets the accumulated eject number 323 (step S507). For example, during a non-busy period, when no print jobs are queued up, it means that no print jobs are consecutively instructed. In this case, the image forming apparatus 1 temporarily stops operating after the print job currently being executed ends. When a moment passes after the image forming apparatus 1 stops operating, the user will come to collect the ejected sheets. Therefore, the sheet eject tray is unlikely to become filled.

Example 3

Modification

Based on the above description, a description is given of the fullness detection of the present modification by applying example 3. In this example, the preconditions are as follows.

Defined eject number threshold: 150 sheets (in units of plain paper)

Sheet type count value table: as illustrated in FIG. 4

It is assumed that a print job for printing on 40 plain paper sheets is instructed by a user, in the image forming apparatus 1 according to the present modification. In this case, every time a sheet is printed and ejected, the sheet type is determined. The sheet type is plain paper, and therefore every time a sheet is ejected, the accumulated eject number 323 is incremented by one. The accumulated eject number 323 is 40, when printing on 40 plain paper sheets is completed and the 40 plain paper sheets are ejected.

It is assumed that a print job for printing on 40 cardboard sheets is instructed while the 40 plain paper sheets are being printed (i.e., a print job is stored in a job queue). Accordingly, after printing on 40 plain paper sheets is completed, 40 cardboard sheets are subsequently printed. Every time a sheet is printed and ejected, the sheet type is determined. The sheet type is cardboard, and therefore every time a sheet is ejected, the accumulated eject number 323 is incremented by 1.5. By converting the number of cardboard sheets to units of plain paper sheets, the number of printed sheets corresponds to 60. Therefore, the accumulated eject number 323 amounts to 100, when 40 cardboard sheets are ejected.

Furthermore, it is assumed that a print job for printing on 10 plain paper sheets is instructed while the 40 plain paper sheets and the 40 cardboard sheets are being printed. Every time a sheet is printed and ejected, the sheet type is determined. The sheet type is plain paper, and therefore every time a sheet is ejected, the accumulated eject number 323 is incremented by one. Therefore, the accumulated eject number 323 amounts to 110, when the 10 plain paper sheets are ejected. The accumulated eject number 323 is not reset up to this time point.

When print jobs are consecutively instructed one after the other, there is constantly a queued up print job in the job list 325. When there is a queued up print job in the job list 325 (step S506-2), sheets are ejected without resetting the accumulated eject number 323, and therefore the accumulated eject number 323 is continuously accumulated. When the accumulated eject number 323 reaches the defined eject number threshold 321 (150 sheets), it is determined (detected) that the sheet eject tray is filled with ejected sheets.

In this example, it is a busy period during which print jobs are consecutively instructed one after the other, and sheets are continuously ejected without the user collecting the ejected sheets from the sheet eject tray. Therefore, it is determined that the sheet eject tray becomes filled with ejected sheets. However, if it is a non-busy period and print jobs are paused, the accumulated eject number 323 is reset (step S507), and fullness is not detected. In a non-busy period, the image forming apparatus 1 temporarily stops operating after the currently executed print job ends. When a moment passes after the image forming apparatus 1 stops operating, the user will come to collect the ejected sheets. Therefore, the sheet eject tray is unlikely to become filled.

In the present modification, it is assumed that the case of example 3 is applied. It is assumed that example 1 or 2 is not applied. That is to say, the present modification excludes cases where the number of printed sheets (ejected sheets) of each print job in example 3 exceeds the defined eject number threshold 321 at once. Specifically, in the Present modification, it is assumed that the user does not instruct a print job for printing a large number of sheets exceeding the defined eject number threshold 321; it is assumed that the maximum number of sheets to be printed in each print job instructed by the user does not exceed the defined eject number threshold 321. For example, when the defined eject number threshold 321 is 150 sheets in units of plain paper sheets, the maximum number of plain paper sheets that can be printed in each print job instructed by the user is 149 sheets.

In the present modification, if the user instructs a print job for printing a large number of sheets exceeding the defined eject number threshold 321, and there are no print jobs queued up in the job list 325, the accumulated eject number 323 is reset and sheets are ejected. Therefore, even if the number of ejected sheets exceeds the defined eject number threshold 321, this cannot be detected. That is to say, if the user instructs a print job for printing a large number of sheets exceeding the defined eject number threshold 321, fullness cannot be detected. Thus, in the present modification, it is necessary to assume that the user instructs a print job for printing a number of sheets that does not exceed the defined eject number threshold 321.

According to one embodiment of the present invention, a sheet eject device, a fullness detecting method, and a computer-readable recording medium are provided, with which it can be detected whether a sheet eject tray is filled with sheets, without requiring a physical mechanism such as a fullness detecting sensor.

The present invention is not limited to the specific embodiments described herein, and variations and modifications may be made without departing from the scope of the present invention.

Elements, expressions or a combination of elements of the present embodiments applied to a method, an apparatus, a system, a computer program, a recording medium, etc., are also effective as embodiments of the present invention.

For example, in an image forming apparatus including a fullness detection sensor, even when the fullness detection sensor breaks down (or fails to detect fullness due to some reason), if the image forming apparatus is provided with functions of an embodiment of the present invention, these functions can be used as supplementary functions for the fullness detection sensor.

What is claimed is:

1. A sheet eject device, comprising:

a printing device to print image data onto a sheet;

a sheet eject tray that the printed sheet is to be ejected;

a memory to store a defined eject interval time and a defined eject number threshold;

a display device; and a processor including a count unit configured to count an accumulated eject number every time a sheet is ejected to the sheet eject tray without requiring a physical counting mechanism, reset the counted accumulated eject number when an interval time exceeds the defined eject interval time, the interval time indicating time from when a sheet being ejected to the sheet eject tray last, and display a message on the display device when the accumulated eject number exceeds the defined eject number threshold, the message prompting that the ejected sheet to be collected from the sheet eject tray.

2. The sheet eject device according to claim 1, wherein the processor further configured to display, on the display device, a screen that can receive an instruction to continue printing.

3. The sheet eject device according claim 1, wherein the processor further configured to display, on the display device, a screen that can receive an instruction to cancel printing.

4. A method for ejecting a sheet from a sheet eject device, the method comprising:

printing image data onto the sheet;

ejecting the printed sheet into a sheet eject tray;

storing a defined eject interval time and a defined eject number threshold;

counting an accumulated eject number every time a sheet is ejected to the sheet eject tray without requiring a physical counting mechanism, resetting the counted accumulated eject number when an interval time exceeds the defined eject interval time, the interval time indicating time from when a sheet being ejected to the sheet eject tray last, and displaying a message on a display device when the accumulated eject number exceeds the defined eject number threshold, the message prompting that the ejected sheet to be collected from the sheet eject tray.

5. The method according to claim 4, further comprising displaying, on the display device, a screen that can receive an instruction to continue printing.

6. The method according to claim 4, further displaying, on the display device, a screen that can receive an instruction to cancel printing.

7. An image forming apparatus, comprising:

an sheet eject device, including:

a printing device to print image data onto a sheet;

a sheet eject tray that the printed sheet is to be ejected;

a memory to store a defined eject interval time and a defined eject number threshold;

a display device; and a processor including a count unit configured to count an accumulated eject number every time a sheet is ejected to the sheet eject tray without requiring a physical counting mechanism, reset the counted accumulated eject number when an interval time exceeds the defined eject interval time, the interval time indicating time from when a sheet being ejected to the sheet eject tray last, and display a message on the display device when the accumulated eject number exceeds the defined eject number threshold, the message prompting that the ejected sheet to be collected from the sheet eject tray.

8. The image forming apparatus according to claim 7, wherein the processor further configured to display, on the display device, a screen that can receive an instruction to continue printing.

9. The image forming apparatus according to claim 7, wherein the processor further configured to display, on the display device, a screen that can receive an instruction to cancel printing.

* * * * *